US005474231A

United States Patent [19]

Froom

[11] Patent Number: 5,474,231

[45] Date of Patent: Dec. 12, 1995

[54] ADHESIVE PORTS FOR FOLDING CARTONS

[75] Inventor: Thomas W. Froom, Pittsford, N.Y.

[73] Assignee: Fold-Pak Corporation, Newark, N.Y.

[21] Appl. No.: 182,746

[22] Filed: Jan. 18, 1994

[51] Int. Cl.[6] ..... B65D 5/02

[52] U.S. Cl. ..... 229/132; 229/145; 229/225; 229/905; 229/935

[58] Field of Search ..... 229/132, 134, 229/136, 145, 146, 224, 225, 226, 227, 900, 905, 933, 935

[56] References Cited

U.S. PATENT DOCUMENTS 4,712,689 12/1987 Froom ..... 229/905
4,712,730 12/1987 Froom ..... 229/905
4,749,086 6/1988 Donohie ..... 229/905
4,819,864 4/1989 Capuano ..... 229/905
4,872,609 10/1989 DePaul ..... 229/905
5,097,958 3/1992 Josephs et al. ..... 229/905
5,160,082 11/1992 McCormich et al. ..... 229/134

*Primary Examiner*—Gary E. Elkins
*Attorney, Agent, or Firm*—Hopgood, Calimafde, Kalil & Judlowe

[57] ABSTRACT

This invention relates to a paperboard blank for forming a carton. The blank comprises top, rear, bottom and front panels hingedly connected in the order named. End wall-forming flaps are hingedly connected to right and left ends of the main panels. Non-linear edges are provided on middle end flaps which define adhesive ports in cooperation with the exterior surface of inner end flaps. A single glue line is deposited or caulked along the non-linear edge to provide secure end walls for a finished carton.

32 Claims, 4 Drawing Sheets

ADHESIVE PORTS FOR FOLDING CARTONS

BACKGROUND OF THE INVENTION

1. Field of Invention

The present invention generally relates to folding paperboard cartons and, more particularly, to an improved carton blank having novel caulking edges which define adhesive ports for superior sealing.

2. Brief Description of the Prior Art

Folding cartons are well known in the packaging art. Typical cartons and corresponding blanks are described in U.S. Pat. Nos. 4,712,689 and 4,712,730 which are incorporated by reference in this disclosure. These cartons are constructed from flat blanks which are pre-cut and prescored on paperboard sheets. Carton blanks have four main panels which are adapted to form the top, rear, bottom and front of an assembled carton. Each main panel has a pair of end flaps which are hingedly connected by score lines formed in the paperboard.

The blanks are folded once and secured with known adhesives to form carton sleeves which are used for packaging retail products, typically consumable goods. During the filling operation, packaging machinery is used to form and seal fully assembled cartons according to a prescribed folding sequence and adhesive pattern dependent on the carton design.

Most currently known carton sleeves have at least three overlapping flaps which require adhesive bonding for effective sealing and formation of end walls. U.S. Pat. No. 4,712,730 describes a state-of-the-art carton blank used to assemble a rectangular, top opening carton. First and second ends of the carton are closed by folding the bottom panel end flaps first; front panel end flaps second; top panel end flaps third and rear panel end flaps fourth and last.

Prior to folding in the fourth down flap, single lines of adhesive are deposited on the bottom panel end flaps. All four end flaps are secured by single glue lines to form a continuous wall at first and second ends of the carton. Commercial products of the type described in U.S. Pat. No. 4,712,730 are manufactured and sold by Fold-Pak Corporation, Newark, N.Y. under the HI TECH® and HI TECH PLUS® trade designations.

According to art-recognized techniques, adhesive attachment of the end-wall forming flaps is difficult to achieve because overlapping end flaps are not co-planar in the folded condition. In specific terms, the inner end flap is spatially removed from the outer end flap by portions of the intervening middle flap. This spatial separation is generally characterized by a single or double thickness of paperboard stock.

U.S. Pat. No. 4,872,609 addresses this problem by describing raised portions formed in the bottom panel end flaps of a typical carton blank. These raised portions are substantially triangular in shape and operably associated with cut-outs formed in the front panel end flaps of an assembled carton. According to this disclosure, the end wall-forming flaps are substantially co-planar so that fourth-folded rear panel end flaps are securely fastened to first-folded bottom panel end flaps with known adhesive patterns.

Carton blanks are typically produced on large paper-board sheets in a multiple configuration. During the blanking operation, score lines are provided to facilitate the flap-folding sequence. Perforations are also cut in the paperboard to form art-recognized tear-away and breakaway features like those described in U.S. Pat. No. 4,712,689. Perforations and score lines are formed by die-cutting and die-stamping the carton blanks in a single, downward direction.

The offset portions of the prior art are raised from the bottom panel end flaps of a carton blank. They are formed in the paperboard stock by stamping the carton blanks in an upward, opposite direction with reference to the score lines and perforations. This procedure involves a reverse die-stamping operation which requires special make ready procedures and additional expense. The presently claimed invention eliminates the need for offset portions and introduces novel improvements which solve the problems existing in the art.

OBJECTS OF THE INVENTION

It is a general object of the present invention to provide improved carton blanks which are easier to seal in the folded condition.

It is an object of the present invention to provide a carton blank having end flaps with non-linear edges defined by notches formed in the paperboard.

It is another object of the present invention to provide a carton blank having end flaps which permit greater latitude for placement of adhesive deposits.

Another object of the present invention is to provide an assembled carton having adhesive ports to insure accurate placement of a single glue line.

A further object of the present invention is to provide an assembled carton with secured, co-planar end walls to reduce leakage of semi-solid product from the assembled carton.

Still further objects of the present invention will be apparent to those skilled in the relevant art.

SUMMARY OF THE INVENTION

The presently claimed invention is directed to adhesive ports which facilitate assembly and sealing of finished cartons. Most currently available blanks comprise bottom, front, top and rear main panels. Each main panel has a left end flap and a right end flap. Score lines are disposed between the main panels and their respective end flaps to permit folding.

The blanks form sleeves and subsequently cartons which are closed by folding the end flaps according to a specific sequence dependent on the selected design. Regardless of the folding sequence, at least three of the end flaps should be adhesively connected by a single glue line to form a sealed end wall. The inner, middle and outer end flaps may be adjacent to any of the bottom, front, top or rear panels, and can be left or right end flaps.

All end flaps are hingedly connected to a main panel by conventional score lines. The middle end flap has a non-linear edge which increases the surface area available for caulking the adhesive deposit. During the folding operation, the inner end flap is folded first and the middle end flap is folded second. Adhesive is deposited or caulked along the non-linear edge of the middle end flap so that a portion of the adhesive overlies the inner end flap. The outer end flap is folded onto the deposited adhesive to form an end wall which secures the carton with a fiber tearing bond between the outer and inner end flaps. In this configuration the middle end flap is bonded to the exterior surface of the inner end flap and the interior surface of the outer end flap.

For purposes of this specification, the term caulking is defined as selective placement of adhesive along a non-linear edge of the middle end flap. Notches formed in the non-linear edge cooperate with the inner end flap to define adhesive ports which insure accurate placement of the glue line used to secure the end flaps.

In particular, the caulked glue line permits adhesive connection between the inner and middle end flaps. This glue line also allows for adhesive connection between the inner and outer end flaps in a manner previously unknown to the art. The overall design eliminates or minimizes inward displacement or "pumping action" of the inner end flap during the folding operation.

All end flaps are secured with a single glue line which reduces manufacturing costs. To maximize the advantages provided by the present invention, the glue line must be carefully deposited along the non-linear edge of the middle end flap when that edge is adjacent to the inner end flap.

DESCRIPTION OF AN ILLUSTRATIVE EMBODIMENT

Figure 1:
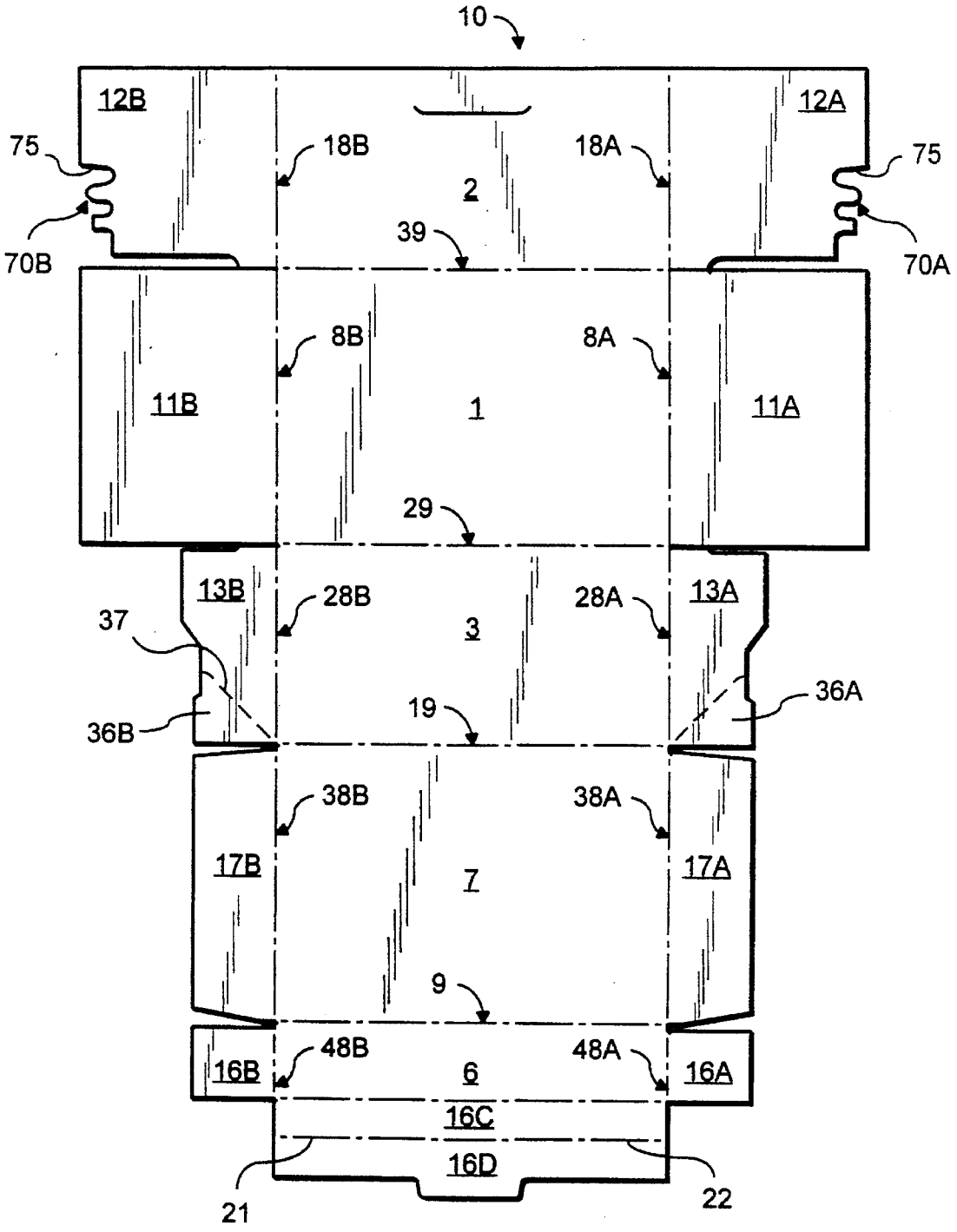
FIG. 1 is a plan view of a flat carton blank with nonlinear, caulking edges shown on the middle panel end flaps.

Referring to FIG. 1, an integral carton blank generally designated 10 comprises cover panel 6, top panel 7, rear panel 3, bottom panel 1 and front panel 2 hingedly connected in the order named. Cover panel 6 and top panel 7 are hingedly connected by score line 9; top panel 7 and rear panel 3 are hingedly connected by score line 19; rear panel 3 and bottom panel 1 are hingedly connected by line 29 and bottom panel 1 and front panel 2 are hingedly connected by score line 39. Each score line is formed in the downward direction with reference to the upper surface of blank 10. Along with other aspects of the present invention, score lines 9, 19, 29 and 39 permit simple manipulation of blank 10 to form an assembled carton for universal packaging of pre-selected products.

As shown generally in the drawings, main panels 1, 2, 3 and 7 have first and second end flaps hingedly connected by adjacent fold lines. Specifically, first and second bottom panel end flaps 11A and 11B are hingedly connected to bottom panel 1 by intermediate fold lines 8A and 8B, respectively. In like terms, first and second front panel end flaps 12A and 12B are hingedly connected to front panel 2 by intermediate fold lines 18A and 18B; and first and second rear panel end flaps 13A and 13B are hingedly connected to rear panel 3 by intermediate fold lines 28A and 28B.

Cover panel 6 includes first and second corner posts 16A and 16B, intermediate tear strip 16C and front panel portion 16D. Tear strip 16C is defined by upper and lower die-cuts or perforations 21 and 22. Like score lines 9, 19, 29, etc., die-cuts 21 and 22 are formed in a downward direction with reference to the upper surface of blank 10. Tear strip 16C is releasably secured to front panel 2 by perforation 21 and releasably secured to front panel portion 16D by perforation 22.

In one embodiment of the present invention, the first and second bottom panel end flaps 11A and 11B are referred to as right and left inner end flaps 11A and 11B, respectively; the first and second front panel end flaps 12A and 12B are referred to as right and left middle end flaps 12A and 12B; and first and second rear panel end flaps 13A and 13B are referred to as right and left outer end flaps 13A and 13B. Notches 75 form nonlinear edges 70A and 70B of middle end flaps 12A and 12B as shown in FIG. 1.

Figure 6:
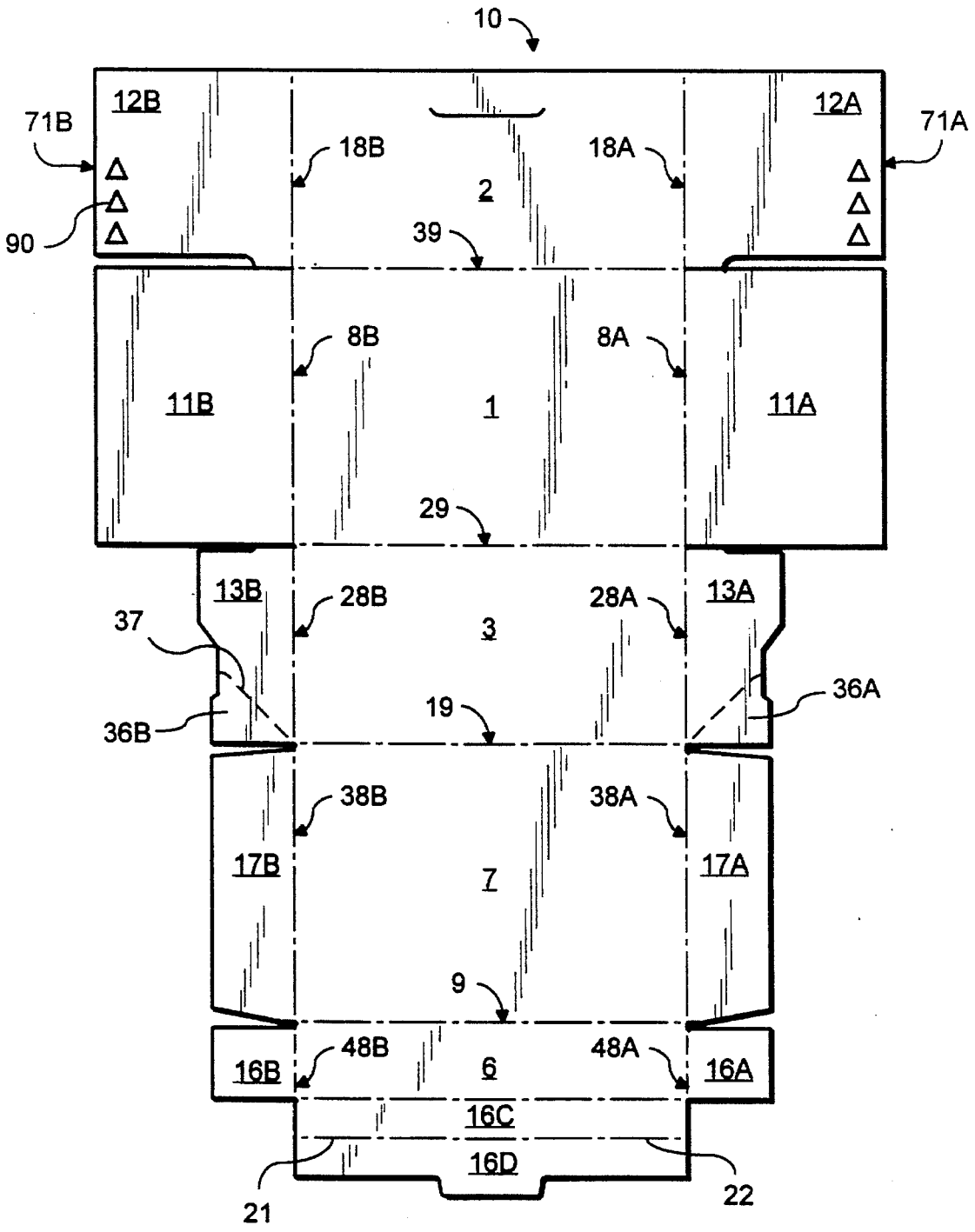
FIG. 6 is a plan view of a flat carton blank illustrating another embodiment of the present invention.

It will be appreciated that any irregular notch or non-linear edge configuration can be employed to form adhesive ports in cooperation with the inner end flap. In an alternative embodiment (FIG. 6), adhesive ports 80 are provided by one or more cut-outs 90 of suitable size and shape (circles, squares, rectangles, triangles, etc.) which are formed in middle end flaps 12A and 12B in an area away from front edges 71A and 71B of said end flaps. Cut-outs 90 are adapted to cooperate with an exposed portion of inner end flaps 11A and lib to form adhesive ports 80 in a carton assembly.

First and second top panel end flaps 17A and 17B are hingedly connected to top panel 7 by intermediate fold lines 38A and 38B; and first and second cover panel end flaps 16A and 16B are hingedly connected to cover panel 6 by intermediate fold lines 48A and 48B.

As illustrated by FIG. 1, breakaway portions 36A and 36B are formed in an upper portion of outer end flaps 13A and 13B by perforations or lines of weakness 37 die-cut in the paper-board stock. Like score lines 9, 19, 29 etc., perforation 37 is die-cut in the same downward direction with reference to the upper surface of blank 10.

Figure 3:
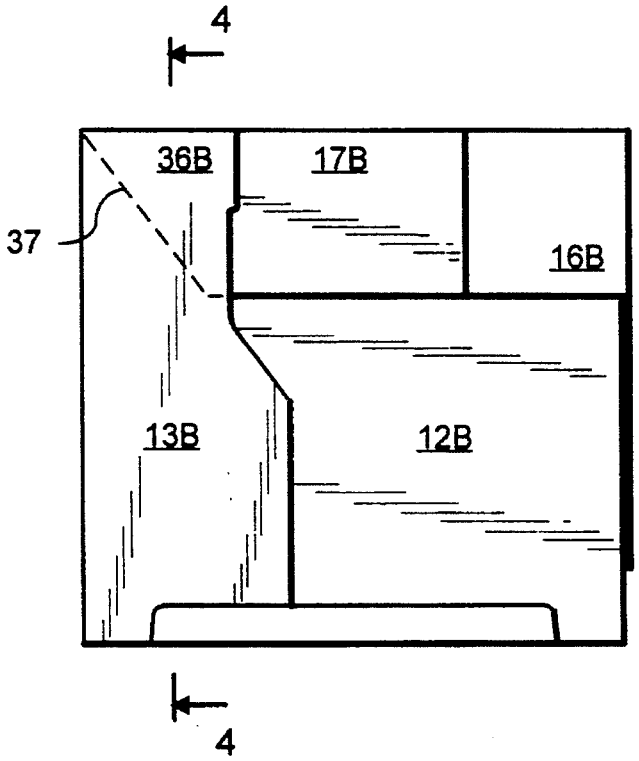
FIG. 3 is an end view of a sealed carton assembled from the sleeve shown in FIG. 2.

According to the present invention, breakaway portions 36A and 36B of blank 10 are adapted for adhesive attachment to an underlying portion of top panel end flaps 17A and 17B in an assembled carton. Adhesive attachment is preferably achieved by extending the single glue lines which are used to secure the end wall-forming flaps. FIG. 3 includes an end view of outer end flap 13B showing the placement of breakaway portion 36B.

Figure 2:
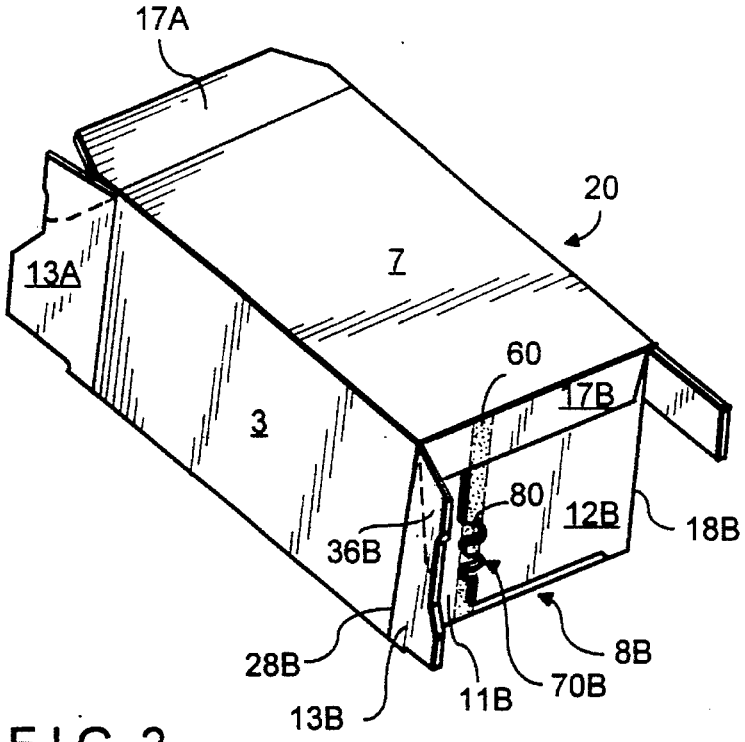
FIG. 2 is a perspective view of a carton sleeve formed by folding the blank illustrated in FIG. 1.

Using blank 10, a carton is assembled by first forming an intermediate carton sleeve 20. Front panel 2 of blank 10 is folded along score line 39 to overlie a portion of bottom panel 1. Glue is then applied to the interior side of cover panel 6 or the exterior side of front panel 2. Top panel 7 is folded about score line 9 over rear panel 3 and bottom panel 1. In this configuration, cover panel 6 is adhesively secured to the exterior surface of front panel 2 to form a carton sleeve as illustrated in FIG. 2.

A carton is next formed from this partially assembled sleeve. As shown in greater detail by FIG. 2, intermediate sleeve 20 is formed into a carton by arranging inner end flap 11B, middle end flap 12B, top panel end flap 17B and outer end flap 13B according to an art-recognized flap folding sequence. Inner end flap 11B is first folded along score line 8B; and middle end flap 12B is next folded along score line 18B. At this point in the flap-folding sequence, single glue line 60 is caulked along non-linear edge 70B in and around notches 75 to insure accurate placement of single glue line 60.

Top end flap 17B is folded third along score line 38B and outer end flap 13B is folded fourth along score line 28B to contact inner end flap 11B and middle end flap 12B. As shown in FIG. 2, non-linear edge 70B of middle end flap 12B overlies a portion of inner end flap 11B to form adhesive ports 80.

The end wall shown in FIG. 3 is similarly created by folding inner end flap 11B first; middle end flap 12B second; top panel end flap 17B third; outer end flap 13B fourth and corner post 16B fifth. An identical flap-folding sequence is subsequently performed to close the opposite end of a fully assembled carton.

Inner end flap 11B is first folded substantially perpendicular to bottom panel 1. In this position, inner end flap 11B essentially closes the partially assembled carton 20. Middle end flap 12B is next folded inwardly and substantially perpendicular to front panel 2 to overlap a portion of inner end flap 11B. Top panel end flap 17B is then folded down to overlie a portion of middle end flap 12B and a coincident portion of inner end flap 11B.

In an alternative embodiment of this invention (FIG. 6), single glue line 60 is deposited on inner end flap 11B by art-recognized techniques. Adhesive ports 80 are formed when middle end flap 12B is folded to overlie a portion of inner end flap lib and cut-outs 90 are placed in contact with single glue line 60.

With respect to both illustrative embodiments, a fiber tearing bond is provided by glue deposited along non-linear edge 70B and inside adhesive ports 80. Single glue line 60 is extended onto the exterior surface of top panel end flap 17B such that breakaway feature 36 will be secured to an underlying portion of top panel end flap 17B in a fully assembled carton.

Figure 4:
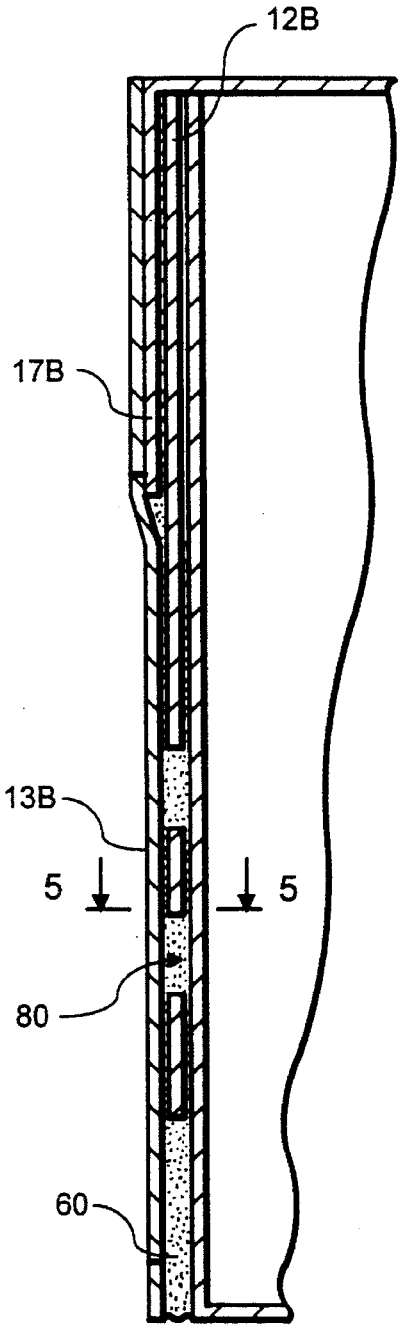
FIG. 4 is a rear, fragmentary view taken along line 4—4 of FIG. 3.

As shown by the fragmentary view of FIG. 4, single glue line 60 may be deposited in adhesive ports 80 to a thickness approximately equal to one width of paperboard. Single glue line 60 therefore contributes to the co-planar arrangement of the present invention. Outer end flap 13B is substantially co-planar with top panel end flap 17B; and middle end flap 12B is substantially co-planar with single glue line 60 deposited in adhesive ports 80. This co-planar arrangement improves adhesion between the end flaps and provides increased stability for a fully assembled carton.

Figure 5:
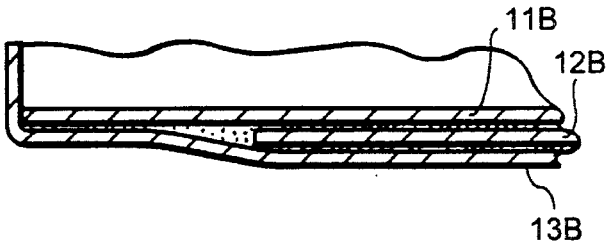
FIG. 5 is a bottom, fragmentary view taken along line 5—5 of FIG. 4.

As illustrated by FIG. 5, outer end flap 13B directly contacts inner end flap lib at the lower, rearward portion of the end wall. In this region the outer surface of inner end flap lib is adhesively connected to the inner surface of outer end flap 13B.

During a typical filling operation, preselected solid or semi-solid products such as candy, ice cream, snack chips, novelty items and the like are delivered to the receptacle formed by main panels 1, 2, 3, 6 and 7 and the end wall-forming flaps shown in FIG. 3. An identical flap-folding sequence is subsequently performed on the opposite end, and the previously described adhesive deposition techniques are repeated to secure the carton.

Various modifications and alterations to the present invention may be appreciated based on a review of this disclosure. These changes and additions are intended to be within the scope and spirit of this invention as defined by the following claims.

What is claimed is:

1. An integral blank for forming a carton, said blank comprising:

(a) cover, top, rear, bottom and front panels hingedly connected in the order named, said cover, top, rear, bottom and front panels each having left and right ends;

(b) left and right inner end flaps hingedly connected to said left and right ends of said bottom panel;

(c) left and right middle end flaps hingedly connected to said left and right ends of said front panel, said left middle end flap having a first non-linear edge and said right middle end flap having a second non-linear edge; and (d) left and right outer end flaps hingedly connected to said left and right ends of said rear panel;

wherein said blank is adapted to form said carton in which said inner end flaps are folded first, said middle end flaps are folded second to overlie a portion of said inner end flaps and provide at least one adhesive port having at least two opposing sides which will increase length of adherence of at least one of said non-linear edges, said at lease one adhesive port defined by said at least one non-linear edge of said middle end flaps in conjunction with and at least one of said inner end flaps, said top end flaps are folded third, said outer end flaps are folded fourth and said left and right ends are substantially closed.

2. The blank of claim 1, wherein said cover, top, rear, bottom and front panels are connected by score lines formed in the blank.

3. The blank of claim 2, wherein said left and right outer end flaps comprise a breakaway portion defined by a line of weakness formed in the blank.

4. The blank of claim 3, wherein said cover panel comprises a releasably secured tear strip defined by upper and lower lines of weakness formed in the blank.

5. The blank of claim 4, wherein said score lines and said lines of weakness are formed in the same direction with reference to a plane defined by the blank.

6. A carton sleeve formed from an integral blank, said carton sleeve comprising:

(a) cover, top, rear, bottom and front panels hingedly connected in the order named, said cover, top, rear, bottom and front panels each having left and right ends;

(b) left and right inner end flaps hingedly connected to said left and right ends of said bottom panel;

(c) left and right middle end flaps hingedly connected to said left and right ends of said front panel, said left middle end flap having a first non-linear edge and said right middle end flap having a second non-linear edge;

(d) left and right outer end flaps hingedly connected to said left and right ends of said rear panel; and (e) said cover panel is adhesively connected to said front panel;

wherein said carton sleeve is adapted to form said carton in which said inner end flaps are folded first, said middle end flaps are folded second to overlie a portion of said inner end flaps and provide at least one adhesive port having at least two opposing sides which will increase length of adherence of at least one said non-linear edges, said at least one adhesive port defined by said at least one non-linear edge of said middle end flaps in conjunction with at least one of said inner end flaps, said top end flaps are folded third, said outer end flaps are folded fourth and said left and right ends are substantially closed.

7. The carton sleeve of claim 6, wherein said cover, top, rear, bottom and front panels are connected by score lines formed in the blank.

8. The carton sleeve of claim 7, wherein said left and right outer end flaps comprise a breakaway portion defined by a line of weakness formed in the blank.

9. The carton sleeve of claim 8, wherein said cover panel comprises a releasably secured tear strip defined by upper and lower lines of weakness formed in the blank.

10. The carton sleeve of claim 9, wherein said score lines and said lines of weakness are formed in the same direction with reference to a plane defined by the blank.

11. A carton formed from an integral blank, said carton comprising:

(a) cover, top, rear, bottom and front panels hingedly connected in the order named, said cover, top, rear, bottom and front panels each having left and right ends;

(b) left and right inner end flaps hingedly connected to said left and right ends of said bottom panel;

(c) left and right middle end flaps hingedly connected to said left and right ends of said front panel, said left middle end flap having a first non-linear edge and said right middle end flap having a second non-linear edge;

(d) left and right outer end flaps hingedly connected to said left and right ends of said rear panel;

(e) said cover panel is adhesively connected to said front panel; and (f) said inner end flaps are folded first, said middle end flaps are folded second to overlie a portion of said inner end flaps and provide at least one adhesive port having at least two opposing sides which increases length of adherence of at least one of said non-linear edges, said at least one adhesive port defined by said at least one non-linear edge of said middle end flaps in conjunction with at least one of said inner end flaps, said top end flaps are folded third, said outer end flaps are folded fourth and said left and right ends are substantially closed.

12. The carton of claim 11, wherein said inner and middle end flaps are adhesively connected by single glue lines deposited along said non-linear edges of said middle end flaps.

13. The carton of claim 12, wherein said cover, top, rear, bottom and front panels are connected by score lines formed in the blank.

14. The carton of claim 14, wherein said left and right outer end flaps comprise a breakaway portion defined by a line of weakness formed in the blank.

15. The carton of claim 14, wherein said cover panel comprises a releasably secured tear strip defined by upper and lower lines of weakness formed in the blank.

16. The carton of claim 15, wherein said score lines and said lines of weakness are formed in the same direction with reference to a plane defined by the blank.

17. An integral blank for forming a carton, said blank comprising:

(a) cover, top, rear, bottom and front panels hingedly connected in the order named, said cover, top, rear, bottom and front panels each having left and right ends;

(b) left and right inner end flaps hingedly connected to said left and right ends of said bottom panel;

(c) left and right outer end flaps hingedly connected to said left and right ends of said rear panel;

(d) left and right middle end flaps hingedly connected to said left and right ends of said front panel, said middle end flaps having at least one completely enclosed cut-out which is formed in at least one of said middle end flaps in an area which will underly at least one of said outer end flaps when said carton is fully assembled; and wherein said blank is adapted to form said carton in which said inner end flaps are folded first, said middle end flaps are folded second to overlie a portion of said inner end flaps and provide at least one adhesive port defined by said at least one completely enclosed cut-out of said middle end flaps in conjunction with at least one of said inner end flaps, said top end flaps are folded third, said outer end flaps are folded fourth and said left and right ends are substantially closed.

18. The blank of claim 17, wherein said cover, top, rear, bottom and front panels are connected by score lines formed in the blank.

19. The blank of claim 17, wherein said left and right outer end flaps comprise a breakaway portion defined by a line of weakness formed in the blank.

20. The blank of claim 17, wherein said cover panel comprises a releasably secured tear strip defined by upper and lower lines of weakness formed in the blank.

21. The blank of claim 17, wherein said score lines and said lines of weakness are formed in the same direction with reference to a plane defined by the blank.

22. A carton sleeve formed from an integral blank, said carton sleeve comprising:

(a) cover, top, rear, bottom and front panels hingedly connected in the order named, said cover, top, rear, bottom and front panels each having left and right ends;

(b) left and right inner end flaps hingedly connected to said left and right ends of said bottom panel;

(c) left and right outer end flaps hingedly connected to said left and right ends of said rear panel;

(d) left and right middle end flaps hingedly connected to said left and right ends of said front panel, said middle end flaps having at least one completely enclosed cut-out which is formed in at least one of said middle end flaps in an area which will underly at least one of said outer end flaps when said carton is fully assembled; and (e) said cover panel is adhesively connected to said front panel;

wherein said carton sleeve is adapted to form said carton in which said inner end flaps are folded first, said middle end flaps are folded second to overlie a portion of said inner end flaps and provide at least one adhesive port defined by said at least one completely enclosed cut-out of said middle end flaps in conjunction with at least one of said inner end flaps, said top end flaps are folded third, said outer end flaps are folded fourth and said left and right ends are substantially closed.

23. The carton sleeve of claim 22, wherein said cover, top, rear, bottom and front panels are connected by score lines formed in the blank.

24. The carton sleeve of claim 22, wherein said left and right outer end flaps comprise a breakaway portion defined by a line of weakness formed in the blank.

25. The carton sleeve of claim 22, wherein said cover panel comprises a releasably secured tear strip defined by upper and lower lines of weakness formed in the blank.

26. The carton sleeve of claim 22, wherein said score lines and said lines of weakness are formed in the same direction with reference to a plane defined by the blank.

27. A carton formed from an integral blank, said carton comprising:

(a) cover, top, rear, bottom and front panels hingedly connected in the order named, said cover, top, rear, bottom and front panels each having left and right ends;

(b) left and right inner end flaps hingedly connected to said left and right ends of said bottom panel;

(c) left and right outer end flaps hingedly connected to said left and right ends of said panel;

(d) left and right middle end flaps hingedly connected to said left and right ends of said front panel, said middle end flaps having at least one completely enclosed cut-out which is formed in at least one of said middle end flaps in an area which underlies at least one of said outer end flaps;

(e) said cover panel is adhesively connected to said front panel; and (f) said inner end flaps are folded first, said middle end flaps are folded second to overlie a portion of said inner end flaps and provide at least one adhesive port defined by said at least one completely enclosed cut-out of said middle end flaps in conjunction with at least one of said inner end flaps, said top end flaps are folded third, said outer end flaps are folded fourth and said left and right ends are substantially closed.

28. The carton of claim 27, wherein said inner and middle end flaps are adhesively connected by single glue lines deposited along said non-linear edges of said middle end flaps.

29. The carton of claim 27, wherein said cover, top, rear, bottom and front panels are connected by score lines formed in the blank.

30. The carton of claim 27, wherein said left and right outer end flaps comprise a breakaway portion defined by a line of weakness formed in the blank.

31. The carton of claim 27, wherein said cover panel comprises a releasably secured tear strip defined by upper and lower lines of weakness formed in the blank.

32. The carton of claim 27, wherein said score lines and said lines of weakness are formed in the same direction with reference to a plane defined by the blank.

* * * * *